US009411289B1

(12) United States Patent
Endo

(10) Patent No.: US 9,411,289 B1
(45) Date of Patent: Aug. 9, 2016

(54) ABNORMALITY DETECTION APPARATUS AND IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Katsuya Endo, Fuji Shizuoka (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/795,596

(22) Filed: Jul. 9, 2015

(51) Int. Cl.
*G03G 15/00* (2006.01)

(52) U.S. Cl.
CPC ..... *G03G 15/55* (2013.01)

(58) Field of Classification Search
CPC ..... G03G 15/55
See application file for complete search history.

(56) References Cited

U.S. PATENT DOCUMENTS 5,546,172 A * 8/1996 Seto ..... G03G 15/1645 399/311
2009/0010661 A1* 1/2009 Hamaya ..... G03G 15/0283 399/37
2012/0051761 A1* 3/2012 Tomiyasu ..... G03G 15/0178 399/31
2012/0230715 A1* 9/2012 Ogino ..... G03G 15/1675 399/66

FOREIGN PATENT DOCUMENTS

JP 2000324677 A 11/2000

* cited by examiner

*Primary Examiner* — Sandra Brase
(74) *Attorney, Agent, or Firm* — Patterson & Sheridan, LLP

(57) ABSTRACT

An abnormality detection apparatus includes a transfer output unit configured to output a voltage for image transfer and a voltage having a first value for detection of an internal resistance thereof, which is within a first range, an electrification output unit configured to electrify drums that are included in each of a plurality of color stations at a predetermined potential, a plurality of abnormality detection units configured to output a plurality of abnormality detection signals that indicate existence or nonexistence of abnormality in the color stations, a voltage value output unit configured to output a voltage having a second value that represents signal levels of the plurality of abnormality detection signals, the second value being within a second range different from the first range, and an output circuit configured to output a voltage having the first or second value through a signal line.

20 Claims, 6 Drawing Sheets

FIG. 4

LEAKAGE DETECTION TABLE
0: LEAKAGE GENERATION STATION

| BK | Y | M | C | Vmon(V) |
|---|---|---|---|---|
| 0 | 0 | 0 | 0 | 3.00 |
| 0 | 0 | 0 | 1 | 3.13 |
| 0 | 0 | 1 | 0 | 3.27 |
| 0 | 0 | 1 | 1 | 3.40 |
| 0 | 1 | 0 | 0 | 3.53 |
| 0 | 1 | 0 | 1 | 3.67 |
| 0 | 1 | 1 | 0 | 3.80 |
| 0 | 1 | 1 | 1 | 3.93 |
| 1 | 0 | 0 | 0 | 4.07 |
| 1 | 0 | 0 | 1 | 4.20 |
| 1 | 0 | 1 | 0 | 4.33 |
| 1 | 0 | 1 | 1 | 4.47 |
| 1 | 1 | 0 | 0 | 4.60 |
| 1 | 1 | 0 | 1 | 4.73 |
| 1 | 1 | 1 | 0 | 4.87 |
| 1 | 1 | 1 | 1 | 5.00 |

FIG. 5

RESISTANCE
DETECTION TABLE

| Vout(V) | Vmon(V) |
|---|---|
| -3000 | 0.10 |
| -100 | 2.90 |

ABNORMALITY DETECTION APPARATUS AND IMAGE FORMING APPARATUS

FIELD

Embodiments described herein relate generally to an abnormality detection apparatus, and an image forming apparatus.

BACKGROUND

An electrophotography type image forming apparatus includes a high voltage power supply unit to supply power to a drum, a transfer belt, and a transfer output for paper. In the image forming apparatus, a mechanism for detecting an abnormal leakage due to corona discharge in the high voltage power supply unit, is adopted. For example, the image forming apparatus includes a control unit and a leakage detection block, and the control unit detects the abnormal leakage, based on a leakage detection signal that is input through a signal line from the leakage detection block.

Moreover, in recent years, a diffusion-based color image forming apparatus includes four stations including four drums corresponding to each color of Y (yellow), M (magenta), C (cyan), and Bk (Black). For example, the color image forming apparatus includes the control unit and four leakage detection blocks corresponding to the four stations. The control unit may detect the abnormal leakage based on the leakage detection signals that are input through the four signal lines from the four leakage detection blocks. In this case, the control unit may detect which station of the four stations generates the abnormal leakage.

In addition, the control unit of the image forming apparatus executes resistance detection in a transfer process unit, right before execution of a printing job. For example, in order to measure impedance within the transfer process unit, the control unit instructs a constant current mode with respect to the transfer process unit. In response thereto, a predetermined fixed current flows to the transfer process unit, the generated electromotive voltage is converted into a voltage that is detectable by the control unit, and an analog signal is output for monitoring the voltage. The control unit outputs a control signal for applying an appropriate transfer voltage based on the analog signal that is input through the signal line from the transfer process unit.

DESCRIPTION OF THE DRAWINGS

FIG. 4 is a diagram illustrating an example of a leakage detection table according to an embodiment.

FIG. 5 is a diagram illustrating an example of a resistance detection table according to an embodiment.

DETAILED DESCRIPTION

As described above, in the abnormal leakage detection process in the color image forming apparatus, a large number of signal lines are needed, and in response thereto, a large number of ports are needed for the control unit. In addition, the signal line and the port for the resistance detection process in the transfer process unit are needed.

For example, in order to reduce the number of signal lines and the number of ports for the abnormal leakage detection process, a logical sum signal of the four signals can be generated and output during the abnormal leakage detection process within the high voltage power supply unit. For abnormal leakage detection, only one logical sum signal is input to the control unit through the signal line. However, in this case, it is not possible to ascertain the station generating the abnormality.

Embodiments described herein provide an abnormality detection apparatus, and an image forming apparatus, which are capable of detecting detailed abnormal leakage while reducing the number of signal lines.

In general, according to one embodiment, an abnormality detection apparatus includes a transfer output unit configured to output a voltage for image transfer and a voltage having a first value for detection of an internal resistance thereof, which is within a first range, an electrification output unit configured to electrify drums that are included in each of a plurality of color stations at a predetermined potential, a plurality of abnormality detection units configured to output a plurality of abnormality detection signals that indicate existence or nonexistence of abnormality in the color stations, a voltage value output unit configured to output a voltage having a second value that represents signal levels of the plurality of abnormality detection signals, the second value being within a second range different from the first range, and an output circuit configured to output a voltage having the first or second value through a signal line.

Hereinafter, the embodiments will be described with reference to the drawings.

Figure 1:
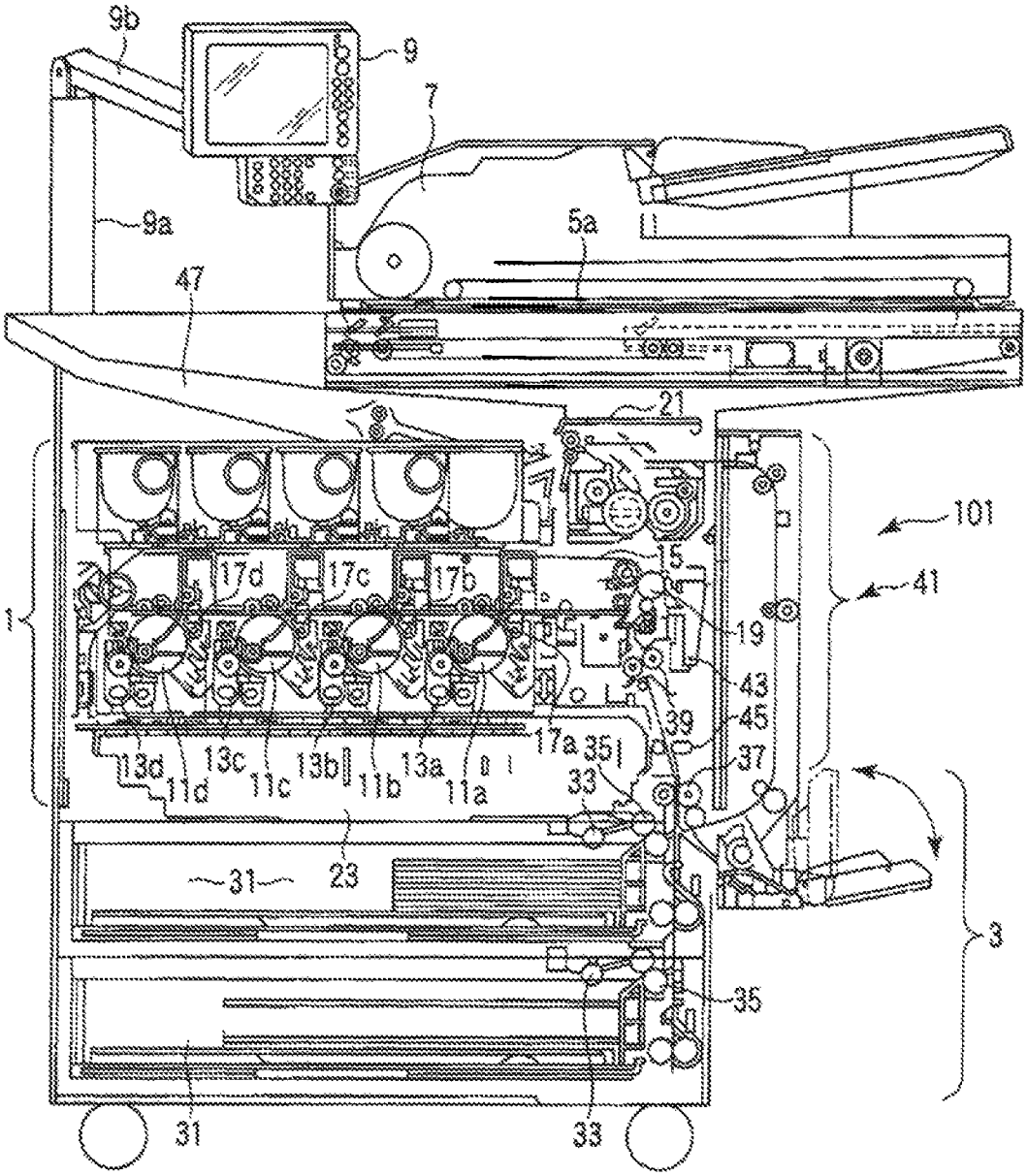
FIG. 1 is a diagram illustrating an example of a Multi-Functional Peripheral (MFP) as an image forming apparatus according to an embodiment.

FIG. 1 is a diagram illustrating an example of a Multi-Functional Peripheral (MFP) as an image forming apparatus including an abnormality detection apparatus.

An MFP 101 illustrated in FIG. 1, includes an image forming unit (image output unit) 1, a paper supply unit 3, and an image reading unit 5. The image forming unit 1 outputs image information, as an image output in a state of fixing toner onto, for example, plain paper that is referred to as a hard copy or a printout, or an OHP sheet that is a transparent resin sheet. The paper supply unit 3 supplies a sheet of arbitrary size using the image output, to the image forming unit 1. The image reading unit 5 captures the image information that is a target forming an image in the image forming unit 1, as image data, from a reading target (referred to as a document, hereinafter) retaining the image information.

The image reading unit 5 includes a document table (document glass) 5*a* supporting the document, and an image sensor converting the image information into the image data, for example, a CCD sensor. The image reading unit 5 converts reflected light that is obtained by irradiating the document that is set on the document table 5*a*, with illumination light from an illumination apparatus, into an image signal by the CCD sensor.

Furthermore, when the document is a sheet, the image reading unit 5 integrally has an automatic document feeder (ADF) 7 that discharges the read document from a discharge unit, and guides the following document to a reading position subsequent to image formation or image capture (which is assumed to be the reading, hereinafter). Instead of the ADF 7, a document cover may be used.

Moreover, the CCD sensor of the image reading unit 5 may be positioned in a movement path of the document of the document table 5*a* where the document is moved by the ADF 7. By positioning the CCD sensor of the image reading unit 5 in the movement path of the document of the document table 5*a* where the document is moved by the ADF 7, the CCD sensor of the image reading unit 5 may read the image information that is included in the document, without positioning the document in the document table 5*a*.

An operation panel (operation unit) 9 that is an operation input unit giving an instruction to start the reading of the image information of the document by the image reading unit 5, and to start the image formation of the image forming unit 1, is positioned in a post 9*a* and a swing arm 9*b* (which are fixed to the image forming unit 1), in a corner of a left side or a right side of the image reading unit 5.

The image forming unit 1 includes an exposure apparatus 23, a first photoreceptor drum 11*a* to a fourth photoreceptor drum 11*d*, and a first development apparatus 13*a* to a fourth development apparatus 13*d*. The exposure apparatus 23 forms a latent image in the first photoreceptor drum 11*a* to the fourth photoreceptor drum 11*d*. The first photoreceptor drum 11*a* to the fourth photoreceptor drum 11*d* retain the latent image. The first development apparatus 13*a* to the fourth development apparatus 13*d* develop the latent image by supplying developer, that is, the toner, to the latent image that is retained by the first photoreceptor drum 11*a* to the fourth photoreceptor drum 11*d*. A transfer belt 15 retains toner images of the respective colors that are formed by the first photoreceptor drum 11*a* to the fourth photoreceptor drum 11*d*, and the first development apparatus 13*a* to the fourth development apparatus 13*d* that correspond thereto, in order of the formation of the toner images.

Moreover, the image forming unit 1 includes a first cleaner 17*a* to a fourth cleaner 17*d*. The first cleaner 17*a* to the fourth cleaner 17*d* remove the toner remaining in the first photoreceptor drum 11*a* to the fourth photoreceptor drum 11*d*, from the first photoreceptor drum 11*a* to the fourth photoreceptor drum 11*d*, respectively.

Additionally, the image forming unit 1 includes a transfer apparatus 19 and a fixing apparatus 21. The transfer apparatus 19 transfers the toner image that is retained by the transfer belt 15, to the plain paper, or the sheet such as the OHP sheet that is a transparent resin sheet. The fixing apparatus 21 fixes the toner image that is transferred to the sheet by the transfer apparatus 19 onto the sheet.

The first development apparatus 13*a* to the fourth development apparatus 13*d* accommodate the toner having an arbitrary color of Y (yellow), M (magenta), C (cyan), and Bk (black), which are used in order to obtain a color image by subtractive color mixing and visualization of the latent image. The latent image is retained by each of the first photoreceptor drum 11*a* to the fourth photoreceptor drum 11*d*, in any color of Y, M, C, and Bk. The order of each color is determined in a predetermined order, depending on image forming process and properties of the toner.

The paper supply unit 3 supplies the sheet to which the toner image is moved to the transfer apparatus 19 at a predetermined timing.

A cassette that is positioned in a plurality of cassette slots 31 (not described in detail) accommodates the sheet of the arbitrary size, and a pickup roller 33 pulls out the sheet from the corresponding cassette, according to an image forming operation. The size of the sheet corresponds to magnification that is requested at the time of the image formation, and dimensions of the toner image that is formed by a main body of the image forming unit 1.

A separation mechanism 35 inhibits the sheet that is pulled out from the cassette by the pickup roller 33 from being two pieces or more.

A plurality of transport rollers 37 send the sheet that is separated into one piece by the separation mechanism 35 toward an aligning roller 39.

The aligning roller 39 sends the sheet to a transfer position where the transfer apparatus 19 comes into contact with the transfer belt 15, in accordance with the timing of transferring the toner image from the transfer belt 15 by the transfer apparatus 19.

The fixing apparatus 21 fixes the toner image corresponding to the image information onto the sheet, and sends the sheet onto which the toner image is fixed, as an image output (hard copy or printout), to a stock unit 47 that is positioned in a space between the image reading unit 5 and the main body of the image forming unit 1.

The transfer apparatus 19 is positioned in an automatic duplex unit (ADU) 41 shifting both faces of the sheet that is an output image (hard copy/printout) where the toner image is fixed by the fixing apparatus 21. A bypass tray is attached to the ADU 41.

In the image forming unit 1, the ADU 41 moves toward the side (right side) when the sheet is clogged (jammed) between the (final) transport roller 37 and the aligning roller 39, between the aligning roller 39 and the fixing apparatus 21, or between the transfer apparatus 19 and the fixing apparatus 21. The ADU 41 integrally has a cleaner 43 configured to clean the transfer apparatus 19.

A media sensor 45 that is positioned between the transport roller 37 and the aligning roller 39 detects a thickness of the sheet that is transported to the aligning roller 39. In the media sensor 45, an optical sensor that is shown in U.S. published patent application 2009/0103148, and U.S. Pat. No. 7,831,160, or a type using a shift of a thickness detection roller that is shown in U.S. provisional application No. 61/043,801, filed on Apr. 10, 2008, may be used.

Figure 2:
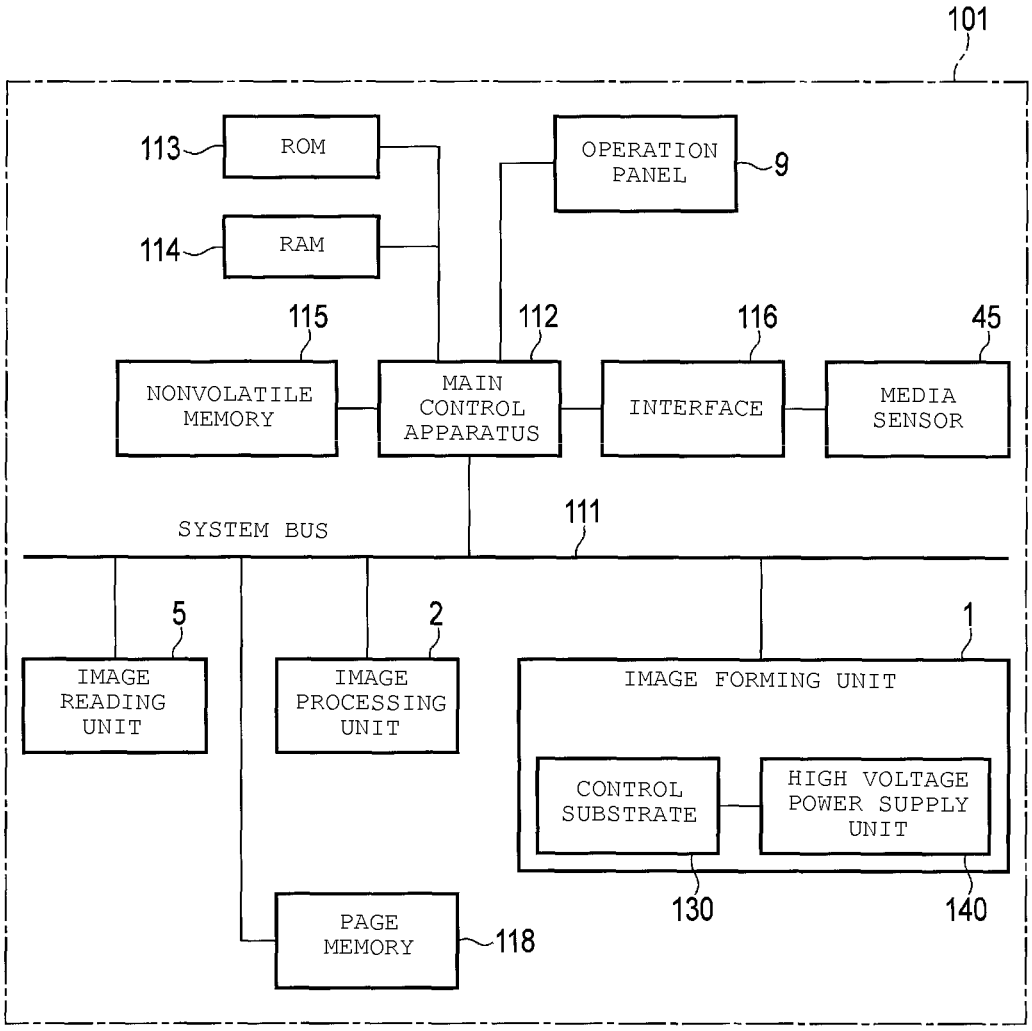
FIG. 2 is a diagram illustrating an example of a control system of the image forming apparatus according to the embodiment.

FIG. 2 is a diagram illustrating an example of a control system of the MFP illustrated in FIG. 1.

The MFP 101 includes the image forming unit 1, an image processing unit 2, the image reading unit 5, a system bus 111, a main control apparatus 112, and the like. The system bus 111 is connected to the image forming unit 1, the image processing unit 2, the image reading unit 5, the main control apparatus 112, and the like. The main control apparatus 112 processes the output of the copy of the document by the image forming unit 1.

The main control apparatus 112 is connected to a Read Only Memory (reading only memory, ROM) 113, a Random Access Memory (rewritable memory, RAM) 114, a nonvolatile memory 115 that stores total number of the image formation and total operation time, an interface 116 that inputs the output of the media sensor 45 to the main control apparatus 112, and the operation panel 9. The image processing unit 2 is connected to a page memory 118.

Figure 3:
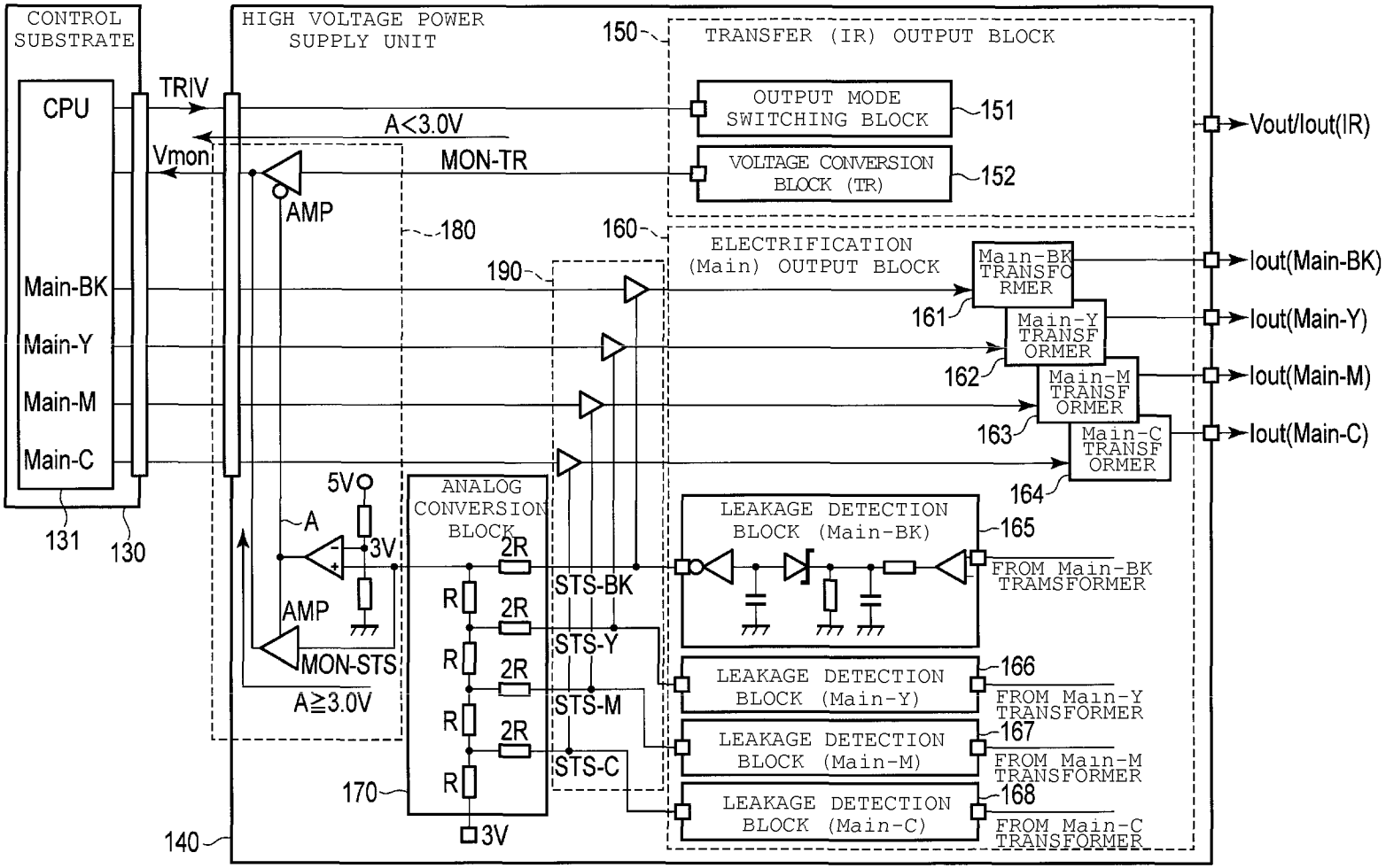
FIG. 3 is a diagram illustrating an example of an abnormality detection apparatus according to an embodiment.

FIG. 3 is a diagram illustrating an example of an abnormality detection apparatus that is included in the image forming unit 1. The image forming unit 1 includes four stations (BK station, Y station, M station, C station) corresponding to the four colors, and the four stations are configured with the first photoreceptor drum 11*a* to the fourth photoreceptor drum 11*d*, the first development apparatus 13*a* to the fourth development apparatus 13*d*, and the first cleaner 17*a* to the fourth cleaner 17*d*.

The abnormality detection apparatus includes a control substrate 130 and a high voltage power supply unit 140. The control substrate 130 includes a CPU (control unit) 131. The high voltage power supply unit 140 includes a transfer output block (transfer output unit) 150, an electrification output block (electrification output unit) 160, an analog conversion block (voltage value output unit) 170, an input circuit 180, an electrification stop circuit 190, and the like. The CPU 131 controls the transfer output block 150 by outputting the control signal (first control signal), and controls the electrification output block 160 by outputting the control signal (second control signal). The transfer output block 150 outputs a voltage for image transfer in response to the input of the control signal from the CPU 131. The electrification output block 160 electrifies the first photoreceptor drum 11*a* to the fourth photoreceptor drum 11*d*, which are included in each of the four stations corresponding to the four colors at predetermined potential, in response to the input of the control signal from the CPU 131.

The transfer output block 150 includes an output mode switching block 151 and a voltage conversion block 152. The CPU 131 of the control substrate 130 outputs a TRIV signal (first control signal) with respect to the transfer output block 150 (output mode switching block 151) of the high voltage power supply unit 140, and controls the transfer output block 150. The transfer output block 150 (output mode switching block 151) switches the output mode based on the TRIV signal. The transfer output block 150 (output mode switching block 151) switches the output mode to any one of a CC-mode (constant current) and a CV-mode (constant voltage), based on the TRIV signal. For example, the transfer output block 150 operates in the CC-mode based on the TRIV signal (L), or operates in the CV-mode based on the TRIV signal (H).

The CPU 131 outputs the TRIV signal (L) with respect to the transfer output block 150 (output mode switching block 151), makes the transfer output block 150 operate in the CC-mode, and executes resistance detection of the transfer output block 150. That is, a predetermined fixed current flows to the transfer output block 150 of the CC-mode for the impedance measurement of the transfer process. In response thereto, the transfer output block 150 (voltage conversion block 152) converts the generated electromotive voltage (such as −3,000 V or −100 V illustrated in FIG. 5) into a voltage (such as 0.1 V or 2.9 V illustrated in FIG. 5) that is detectable by the CPU 131, and provides an analog output as MON-TR.

The electrification output block 160 of the image forming unit 1 has a high voltage output function for drum electrification, and includes transformers 161 to 164 (Main-BK, Main-Y, Main-M, Main-C) corresponding to the four stations, and leakage detection blocks 165 to 168 (Main-BK, Main-Y, Main-M, Main-C) (a plurality of abnormality detection unit) corresponding to the four stations. The leakage detection blocks 165 to 168 output a leakage detection signal (abnormality detection signal) informing existence or nonexistence of abnormality generation, in order to prevent fuming and ignition, in a case of detecting abnormal discharge (leakage) in the corona discharge.

Each of the leakage detection blocks 165 to 168 outputs STS signals (STS-BK, STS-Y, STS-M, STS-C) as a leakage detection signal, and the analog conversion unit 170 converts the leakage detection signal into, for example, a voltage (second voltage value) of 16 stages (second voltage range), according to a combination of the leakage detection signals from the leakage detection blocks 165 to 168, and outputs the converted voltage as a MON-STS signal.

FIG. 4 is a table illustrating an example of the voltage value of 16 stages according to the combination of the leakage detection signals from the leakage detection blocks 165 to 168. The analog conversion unit 170 outputs the voltage value of 16 stages according to the combination of the leakage detection signals from the leakage detection blocks 165 to 168 based on the table. That is, the analog conversion unit 170 may output the different voltage by the station where the leakage is generated and detected. For example, the analog conversion unit 170 outputs the MON-STS signal of 3.8 V in response to the leakage detection signals indicating the leakage detection of the BK station and the C station from the leakage detection blocks 165 and 168.

Figure 6:
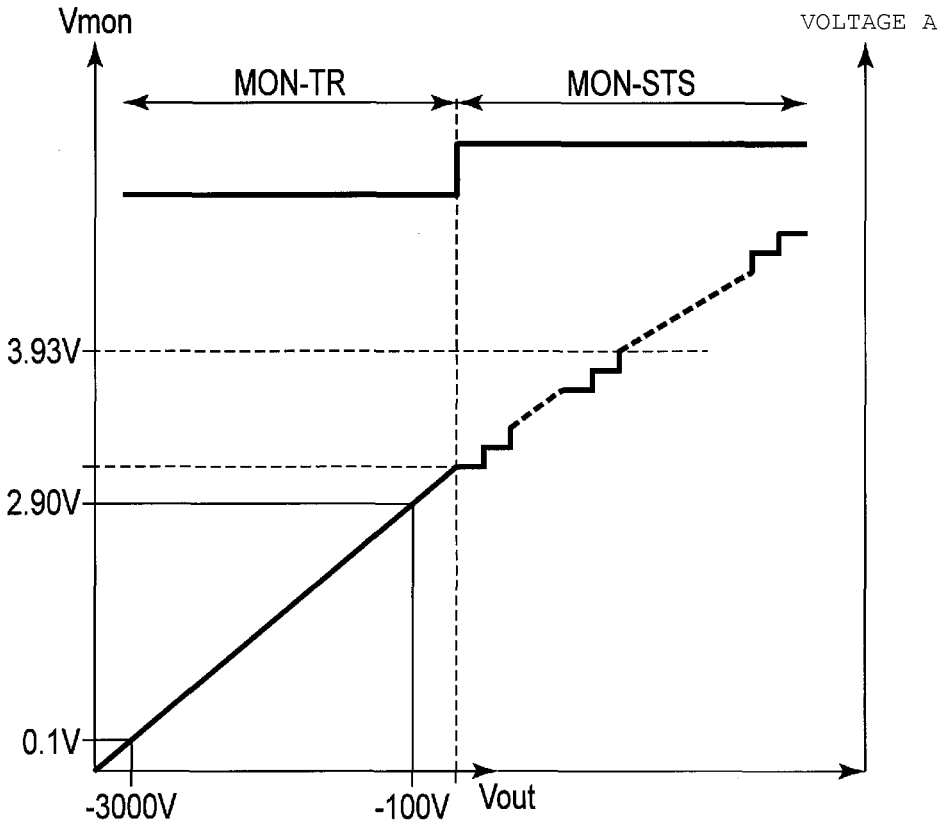
FIG. 6 is a diagram illustrating an example of resistance detection based on the resistance detection table according to the embodiment, and leakage detection based on the leakage detection table according to the embodiment.

The input circuit 180 of the high voltage power supply unit 140 has a configuration of outputting the MON-STS signal of 3.0 V or more as Vmon, if the MON-STS signal is 3.0 V or more, and outputting the MON-TR signal as Vmon, if the MON-STS signal is less than 3.0 V. That is, any one of two signals of the MON-TR signal that is output from the voltage conversion block 152 of the transfer output block 150, and the MON-STS signal that is output from the analog conversion block 170, is output as Vmon. For example, an analog input voltage range of the CPU 131 is divided, and a range (first voltage range) that is from 0 V up to 2.9 V, is assigned as a resistance detection signal of a MON-TR transfer system. A range (second voltage range) that is from 3.0 V to 5.0 V is assigned to the detection of the leakage as MON-STS. The CPU 131 detects the resistance of the transfer output block 150 according to the voltage value (see FIG. 5 and FIG. 6) of Vmon based on the tables of FIG. 4 and FIG. 5. Moreover, the CPU 131 detects the leakage of each of the four stations according to the voltage value (see FIG. 4 and FIG. 6) of Vmon. For example, the MON-STS signal is compared with a predetermined voltage. If the MON-STS signal is the predetermined voltage or more, it is determined that the abnormality (leakage) is not generated, and the MON-TR signal is output as Vmon. Additionally, if the MON-STS signal is less than the predetermined voltage, it is determined that the abnormality (leakage) is generated, and the analog voltage is output based on the setting table illustrated in FIG. 4.

For example, the electrification stop circuit 190 has a circuit configuration of setting a signal that controls electrification on/off to be an electrification off signal, with respect to the station where the abnormal leakage is detected, based on the leakage detection signal (existence of the generation of the abnormal leakage). Without depending on the control of the control substrate 130, it is possible to stop the electrification of the station where the abnormal leakage is detected.

In the embodiments, a case where the resistance detection of the transfer output block 150, and the leakage detection of each of the four stations (stations of the four colors) are achieved by one signal line (one port), is described, but the embodiments are not limited thereto. For example, the embodiments may be applied to an image forming apparatus including one or more stations.

Moreover, detection items are not limited to the above description, and it is possible to achieve the resistance detection, the leakage detection, and another detection (leakage detection relating to the electrification for toner peeling) by one signal line (one port). In this case, by assigning each detection signal corresponding to each detection item to the different voltage values (range of the voltage value), it is possible to detect each detection item differentially.

Figure 7:
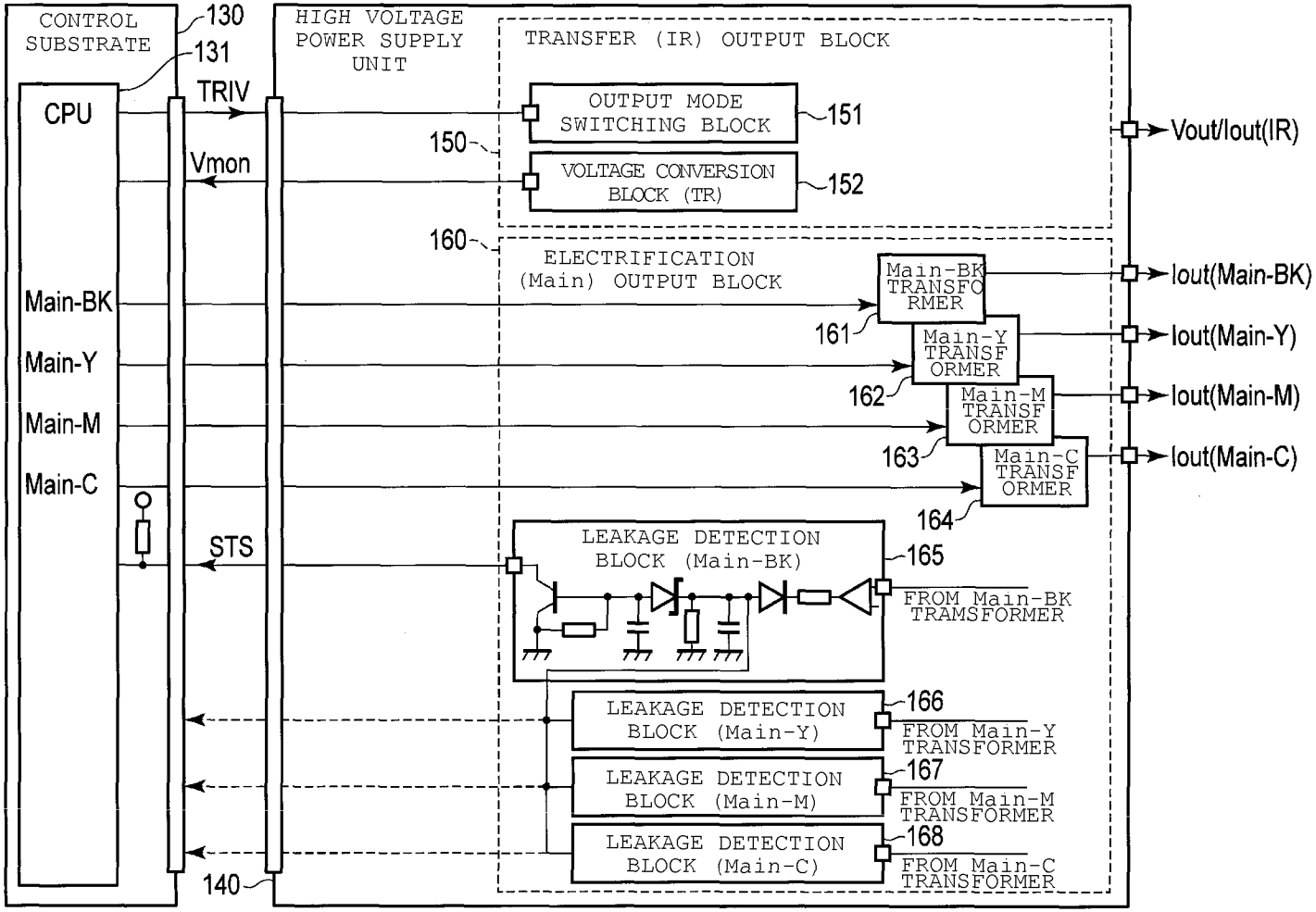
FIG. 7 is a diagram illustrating a comparative example of the abnormality detection apparatus according to the embodiment.

Next, the abnormality detection apparatus illustrated in FIG. 3 is compared with the abnormality detection apparatus illustrated in FIG. 7, and operations and effects of the embodiments will be described. FIG. 7 is a diagram illustrating a comparative example of the abnormality detection apparatus that is included in the image forming unit 1. The same reference signs are attached to common portions in the abnormality detection apparatus in FIG. 3 and the abnormality detection apparatus in FIG. 7.

As illustrated in FIG. 7, for the resistance detection of the transfer output block 150 and the leakage detection of each of the four stations (stations of the four colors), a total five signal lines are needed. For example, in the abnormality detection apparatus illustrated in FIG. 7, by outputting the logical sum signal of the four leakage detection signals in the four stations, the leakage detection is possible, but it is not possible to specify at which station the abnormal leakage is generated.

The abnormality detection apparatus illustrated in FIG. 3, may achieve the resistance detection of the transfer output block 150 and the leakage detection of each of the four stations (stations of the four colors) by one signal line. That is, it possible to reduce a harness between the control substrate 130 and the high voltage power supply unit 140, and the control substrate 130 side may determine the leakage detection conditions of the high voltage power supply unit 140 side and the internal resistance of the transfer output block 150, only by detecting the voltage. Furthermore, the electrification stop circuit 190 is configured to set the signal that controls the electrification on/off to be the electrification off signal, with respect to the station where the abnormal leakage is detected, based on the leakage detection signal (existence of the generation of the abnormal leakage). Without depending on the control of the control substrate 130, it is possible to stop the electrification of the station where the abnormal leakage is detected.

Hereinafter, the embodiments are summarized.

(1) The abnormality detection apparatus of the embodiment is configured to detect (leakage detection blocks 164 to 168) the abnormal leakage of an electrification unit that becomes an ignition factor per station of each color in the high voltage power supply for the image formation (for the image formation of a color MFP, for example).

(2) The abnormality detection apparatus of the embodiment is configured to output (using analog conversion block 170) a predetermined analog voltage, depending on a state of the existence or nonexistence of abnormal leakage detection per station of each color.

(3) The abnormality detection apparatus of the embodiment is configured to supply a predetermined current with respect to the transfer output block 150, convert the electromotive voltage that is generated from the transfer output block 150 into a voltage that is detectable by the control substrate 130, and generate the analog output by setting an output mode of the transfer output block 150 for measuring the impedance within a body of the transfer output block 150 as a constant current. Moreover, the abnormality detection apparatus is configured to control the output in order to output the appropriate transfer voltage in the transfer output block 150 based on a result of the analog output.

(4) The analog signal indicates the existence or nonexistence of the abnormal leakage detection per station of each color and is assigned into the range of the voltage that may be input by the CPU 131 of the control substrate 130. In the range of the voltage that may be input by the CPU 131 of the control substrate 130, the voltage that is the predetermined voltage or less is assigned as the abnormal leakage detection, and the voltage that is higher than the predetermined voltage is assigned as the resistance detection of the transfer output block 150.

(5) The input circuit 180 of the abnormality detection apparatus of the embodiment includes a comparator. The analog signal indicates the existence or nonexistence of the abnormal leakage detection per station of each color and is compared with the predetermined voltage by the comparator Depending on a comparison result, the signal of either one of the analog signal indicating the existence or nonexistence of the abnormal leakage detection per station of each color, or the analog signal indicating the resistance detection of the transfer output block 150, is output.

As to the abnormality detecting apparatus according to the embodiment, in the analog signal that is used for the resistance detection of the transfer system, the analog detection range is divided into the voltage range of the electrification leakage detection and the detection range of the internal resistance of the transfer output block 150. In a case of a voltage other than the voltage range of the electrification leakage detection, the output of the transfer output block 150 is output from the high voltage power supply at all times. When the abnormal leakage is generated, the voltage is output depending on location of abnormal leakage, and the control substrate 130 may detect the generation of the abnormal leakage, and the location thereof, based on the voltage.

Moreover, the abnormality detection apparatus according to the embodiment may prevent ignition and fuming due to the abnormal discharge by stopping (using electrification stop circuit 190) the electrification output of the station where the abnormality is generated.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An abnormality detection apparatus, comprising:

a transfer output unit configured to output a voltage for image transfer and a voltage having a first voltage value for detection of an internal resistance thereof, the first voltage value being within a first voltage range;

an electrification output unit configured to electrify drums that are included in each of a plurality of color stations at a predetermined potential;

a plurality of abnormality detection units configured to output a plurality of abnormality detection signals that indicate existence or nonexistence of abnormality in the plurality of color stations;

a voltage value output unit configured to output a voltage having a second voltage value that represents signal levels of the plurality of abnormality detection signals, the second voltage value being within a second voltage range different from the first voltage range; and an output circuit configured to output a voltage having the first voltage value or the second voltage value through a signal line.

2. The apparatus according to claim 1, wherein the output circuit includes one signal line as the signal line.

3. The apparatus according to claim 1, wherein the abnormality in the plurality of color stations includes an electrification leakage in the plurality of color stations.

4. The apparatus according to claim 3, further comprising:
an electrification stop circuit configured to stop electrification by the electrification output unit based on at least one of the plurality of abnormality detection signals.

5. The apparatus according to claim 1,
wherein the drums include four drums corresponding to four colors.

6. The apparatus according to claim 1, further comprising:
a control unit configured to determine the internal resistance based on the first voltage value of the voltage output by the output circuit, and determine the existence or nonexistence of abnormality based on the second voltage value of the voltage output by the output circuit.

7. The apparatus according to claim 6, wherein
the control unit is further configured to output a first control signal and a second control signal,
the transfer output unit outputs the voltage for image transfer in response to the first control signal; and
the electrification output unit electrifies the drums in response to the second control signal.

8. The apparatus of claim 1, wherein the transfer output unit outputs the voltage having the first voltage value when a fixed current is input thereto.

9. An image forming apparatus, comprising:
an image forming unit; and
an abnormality detection unit, including:
a transfer output unit configured to output a voltage for image transfer and a voltage having a first voltage value for detection of an internal resistance thereof, the first voltage value being within a first voltage range;
an electrification output unit configured to electrify drums that are included in each of a plurality of color stations at a predetermined potential;
a plurality of abnormality detection units each configured to output an abnormality detection signal that indicates existence or nonexistence of abnormality in a respective one of the plurality of color stations;
a voltage value output unit configured to output a voltage having a second voltage value that represents signal levels of the abnormality detection signal, the second voltage value being within a second voltage range different from the first voltage range; and
an output circuit configured to output a voltage having the first voltage value or the second voltage value through a signal line.

10. The image forming apparatus according to claim 9,
wherein the output circuit includes one signal line as the signal line.

11. The image forming apparatus according to claim 9,
wherein the abnormality in the plurality of color stations includes an electrification leakage in the plurality of color stations.

12. The image forming apparatus according to claim 11, further comprising:
an electrification stop circuit configured to stop electrification by the electrification output unit based on at least one of the plurality of abnormality detection signals.

13. The image forming apparatus according to claim 9,
wherein the drums include four drums corresponding to four colors.

14. The image forming apparatus according to claim 9, further comprising:
a control unit configured to determine the internal resistance based on the first voltage value of the voltage output by the output circuit, and determine the existence or nonexistence of abnormality based on the second voltage value of the voltage output by the output circuit.

15. A method of detecting abnormality in an image forming apparatus, comprising:
outputting a voltage having a first voltage value for detection of an internal resistance of a transfer output unit configured to output a voltage for image transfer, the first voltage value being within a first voltage range;
electrifying drums included in a plurality of color stations at a predetermined potential;
outputting a voltage having a second voltage value that represents signal levels of a plurality of abnormality detection signals from a plurality of abnormality detection units, the plurality of abnormality detection signals indicating existence or nonexistence of abnormality in the plurality of color stations, the second voltage value being within a second voltage range different than the first voltage range; and
selectively outputting either the first voltage value or the second voltage value through a signal line; and
detecting abnormality in any of the plurality of color stations based on the second voltage value when the voltage having the second voltage is selectively output.

16. The method according to claim 15, further comprising:
determining the internal resistance base on the first voltage value, when the voltage having the first voltage is selectively output.

17. The method according to claim 15, wherein the abnormality in the plurality of color stations includes an electrification leakage in the plurality of color stations.

18. The method according to claim 17, further comprising:
stopping electrification of the drums based on at least one of the plurality of abnormality detection signals.

19. The method according to claim 15, wherein the plurality of color stations corresponds to four colors.

20. The method according to claim 15, wherein the voltage having the first voltage value is output when a fixed current is input to the transfer output unit.

* * * * *